United States Patent [19]

Campbell et al.

[11] Patent Number: 4,795,029

[45] Date of Patent: Jan. 3, 1989

[54] SHOE DISPLAY AND STORAGE DEVICE

[76] Inventors: Robert B. Campbell, 420 E. 54th St., New York, N.Y. 10022; Paul Landau, 55 E. 9th St., New York, N.Y. 10003

[21] Appl. No.: 79,180

[22] Filed: Jul. 29, 1987

[51] Int. Cl.[4] ..... B65D 85/18; B65D 65/16

[52] U.S. Cl. ..... 206/278; 206/45.31; 206/470; 206/471; 206/508; 211/38

[58] Field of Search ..... 206/278, 461, 462, 467, 206/508, 470, 45.31, 45.34, 471, 45.33; 211/34, 38; 190/16

[56] References Cited

U.S. PATENT DOCUMENTS

| | | | |
|---|---|---|---|
| 3,365,094 | 1/1968 | Palson | 220/337 |
| 3,369,660 | 2/1968 | Hartman | 206/462 |
| 3,414,093 | 12/1968 | Chostner | 190/16 |
| 3,463,309 | 8/1969 | Szostek | 206/470 |
| 4,423,811 | 1/1984 | Knapp | 206/470 X |
| 4,453,629 | 6/1984 | Goldberg | 206/508 X |
| 4,524,867 | 6/1985 | Klein et al. | 206/45.34 X |
| 4,681,223 | 7/1987 | Roberts | 206/470 X |

*Primary Examiner*—Stephen Marcus
*Assistant Examiner*—Bryon Gehman
*Attorney, Agent, or Firm*—Liddy, Sullivan, Galway, Begler & Peroff

[57] ABSTRACT

A transparent container is formed essentially with the shape of a rectangular parallelelepiped by a base and a cover which are hingedly attached together and enclose a cavity within which is disposed preformed shapes for receiving and positioning one or more articles to be displayed and stored. In the preferred embodiment the articles to be displayed and stored comprise a pair of shoes. The shoes are stored in the base in an interlocked heel to sole manner in the preformed inner shapes. This affords efficiency in display packing and shipment. The storage device is adaptable to all size and styles of men's, women's and children's shoes as well as to other articles.

12 Claims, 3 Drawing Sheets

SHOE DISPLAY AND STORAGE DEVICE

BACKGROUND OF THE INVENTION

1. Field of Application

This invention relates to article display and storage devices; and more particularly to such devices for the display and storage of shoes.

2. Description of the Prior Art

Plastic packages are widely used for a variety of items ranging from food to hardware. These packages allow the visual display of product to the prospective customer allowing customer evaluation prior to purchase without opening the package. Some plastic packages have the added feature of recloseability and storage of unused product.

Some of the earliest plastic packages were blister packs wherein a plastic formed in a predetermined shape, generally known as the blistic or bubble, is often affixed to a paper or plastic backing board. These packages are extensively used in rack merchandising of products. These types of packages however do not seem to be adaptable to large items. The prior art listed below show a number of United States Letter Patents which are representative of blister packages. Such patents include: U.S. Pat. Nos. 4,300,682 for "Blister Package" issued to M. W. Kuchenbecker on Nov. 17, 1981; 4,166,535 for "Package Structure" granted on Sept. 4, 1979 to D. A. Gilling; U.S. Pat. No. 4,119,203 for "Recloseable Hinged Blister Card Package" issued Oct. 10, 1978 to M. W. Kuchenbecker; 4,499,353 for "Blister Package" issued Feb. 12, 1985 to T. A. Shields and 3,397,774 for "Container" issued Aug. 20, 1968 to J. Tjaden.

A similar package for merchanidsing small articles, with a semi-rigid recloseable package is shown in U.S. Pat. No. 3,463,309 for "Reusable Package" granted to J. J. Szostek on Aug. 26, 1969. Another resealable package for a paint brush is shown in U.S. Pat. No. 4,423,811 issued on Jan. 3, 1984 to J. F. Knapp for "Molded Container". Neither of these seem to be adaptable to large items such as shoes.

Shoes are shown to be held side-by-side on a base and fastened thereto in U.S. Pat. No. 3,635,353 for "Footwear Holder" granted to R. Matsubara on Jan. 18, 1972. This folder does not minimize storage space, allow stackability or enclose the shoes for protection during storage.

Another package, but one for the display of jewelry, having a hinged cover is shown in U.S. Pat. No. 4,016,972 for "Display Container for Neck Chains and the Like" issued to E. Szamborski on Apr. 12, 1977. This package, however, is not adaptable to the packaging of shoes.

SUMMARY OF THE INVENTION

It is therefore an object of this invention to provide a new and improved display type storage device.

It is another object of this invention to provide a new and improved shoe storage package.

It is another object of this invention to provide a new and improved hinged package with an article holding means therein to facilitate positioning of the stored article in the package.

It is yet another object of this invention to provide a new and improved transparent hinged shoe storage device.

It is still another object of this invention to provide a new and improved transparent hinged article storage device with a securing means in the lid thereof.

It is a further object of this invention to provide a new and improved transparent hinged article storage device with a securing means in the lid thereof which minimizes package size when articles such as shoes are fit into a holding means provided within the device.

It is still yet a further object of this invention to provide a new and improved transparent hinged article storage package in the form of a rectangular parallelepiped with a securing means in the lid thereof, and a flange with a hanger means which minimizes package size when articles such as shoes are fit into a holding means therein provided within the package.

Other objects, features, and advantages of the invention in its details of construction and arrangement of parts will be seen from the above, from the following description of the preferred embodiment when considered with the drawing and from the appended claims.

DESCRIPTION OF THE PREFERRED EMBODIMENT

Figure 1:
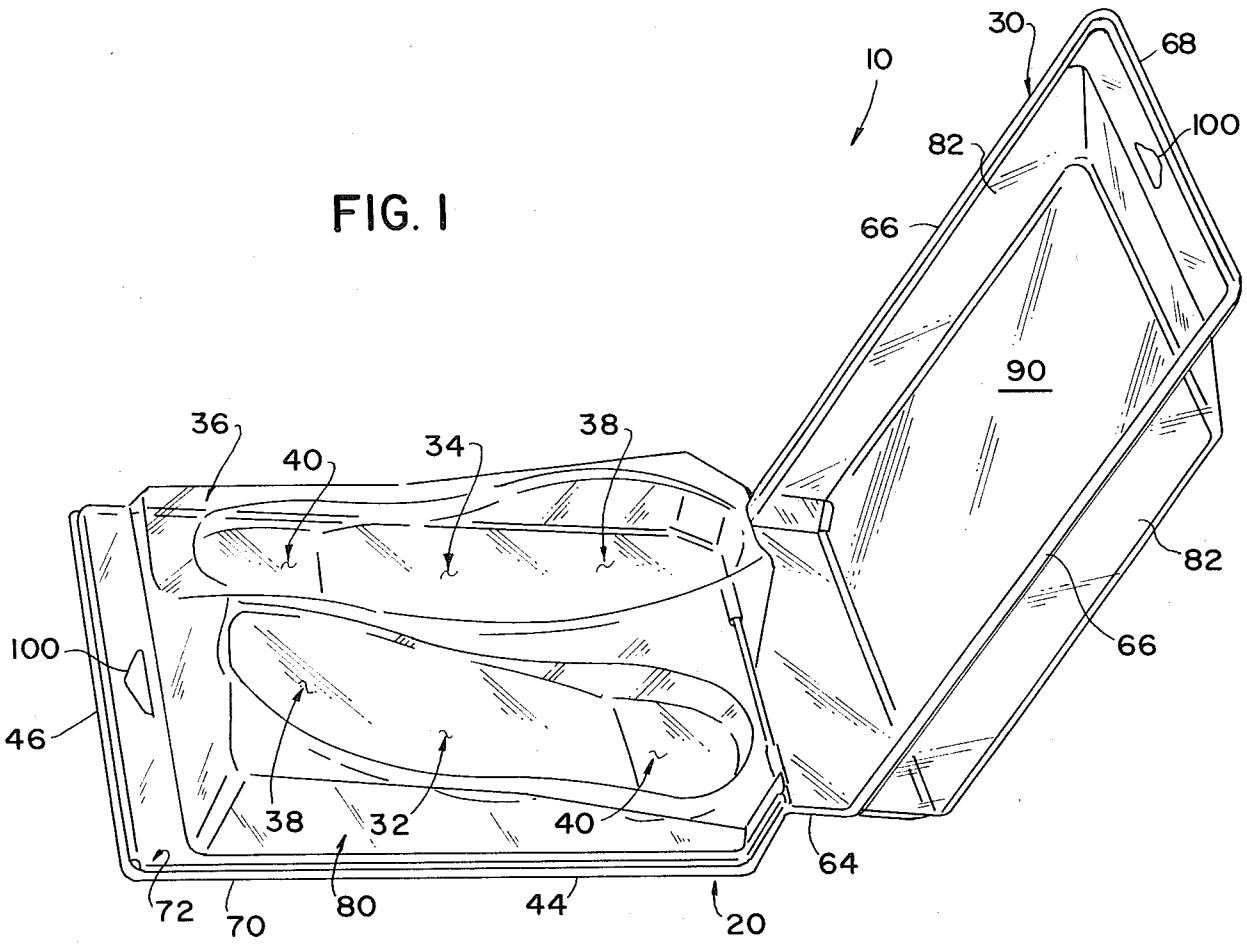
FIG. 1 is a perspective view of an article display and storage device for shoe storage incorporating the instant invention, and showing its base and cover in an open condition.

With reference to FIG. 1, there is generally shown at 10 an article display and storage device particularly for the display and storage of shoes. Device 10 comprises a base 20 and a cover 30. The preferred material of construction of base 20 and cover 30 is polyvinylchloride "PVC" or other suitable transparent plastic material which may be neutral or color tinted.

Figure 2:
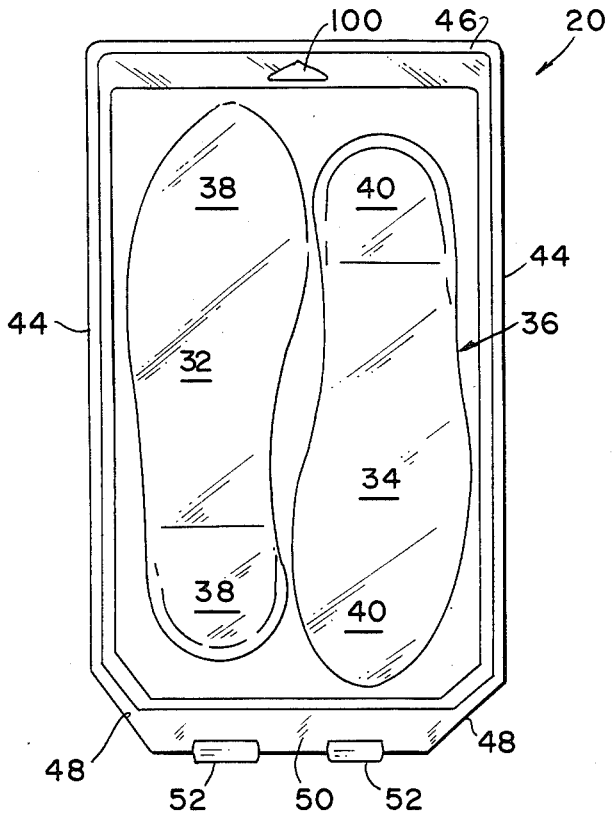
FIG. 2 is a plan view of the base of the device of FIG. 1.

A first inner shape 32 and a second inner shape 34 are formed in a bottom surface 36 of base 20 (FIG. 2). Both shapes 32 and 34 are in the form of a man's shoe and of a predetermined size and configuration to accommodate a pair of shoes of a given size style and shape.

Shoe display and storage device 10 is thus formed to different sizes for different shoe sizes (as for children, young people, boys, men and the like) either in predetermined ranges sized to accommodate a number of shoe sizes or in sizes specific to each shoe size. Device 10 is also provided with inner shapes 32 and 34 depending on various shoe styles and configurations. The colors to which device 10 are tinted may be selected as a code to further define the type of quality of the stored shoes.

Figure 4:
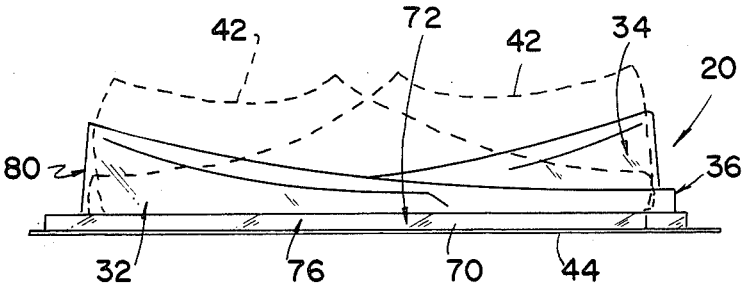
FIG. 4 is a side view of the base of the device of FIG. 1, showing a pair of shoes in phantom disposed therein.

Inner shape 32 is deployed with a sole portion 38 for one shoe adjacent to a heel portion 40 of inner shape 34 for the adjacent shoe. Conversely, inner shape 34's heel portion 40 is adjacent to sole portion 38 of inner shape 32. Bottom 36 of base 20 is shown to have a slightly concave form (FIG. 4) when viewed perpendicular to a shoe 42. While a man's shoe is shown the configuration of bottom 36 may be for a women's shoe or child's shoe.

Figure 3:
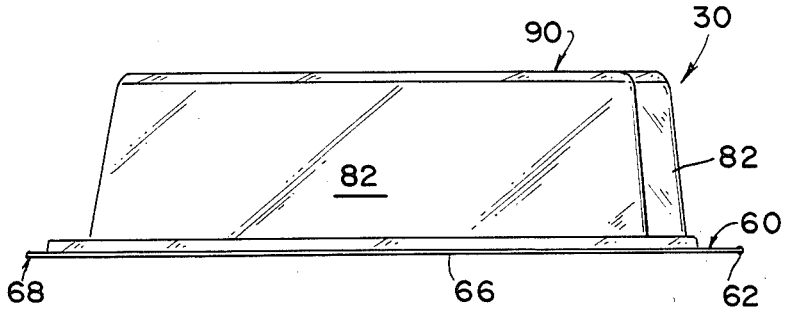
FIG. 3 is a side view of the cover of the device of FIG. 1.

Base 20 further consists of a pair of side lips 44 extending from a header 46 to a pair of intermediate lips 48. A hinge lip 50, extending between intermediate lips 48, has a pair of hinge members 52 affixed thereto. In FIG. 3 a hinge rib 60 extends the width of cover 30, proximate a cover hinge lip 62. Cover 30 has a set of lips 64 (FIG. 1), 66 and 68 corresponding to base lips 48, 44 and 46 and which are disposed for coaction respectively therewith. A sidewall 70 (FIG. 4) extends from lips 44, 46, 48 and 50 a predetermined distance to an upper lip surface 72.

Surface 72 extends to a set of sidewalls 80. Lips 44, 46, 48 and 50, sidewalls 70, and upper lip surface 72 further define a recess 76 (FIG. 4) of a size and configuration to receive an upper portion of cover 30 as will be hereinafter explained. A sidewall 80 extends from upper lip surface 72 to surface 36 and is formed at a predetermined draft angle in base 20. Similarly a set of sidewalls 82 extend from lips 62, 64, 66 and 68 of cover 30 to a top surface 90 thereof and are formed at a predetermined draft angle in cover 30.

Figure 5:
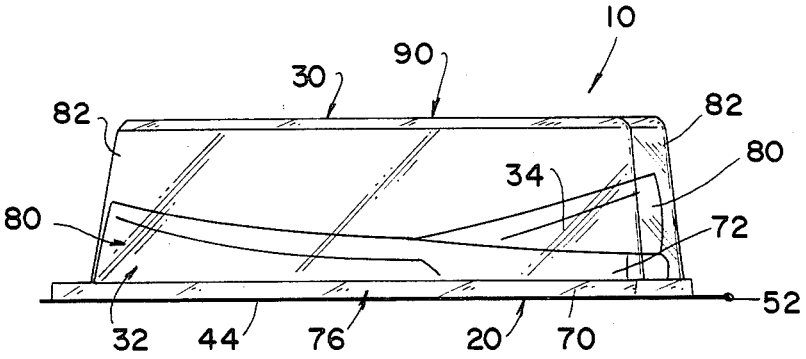
FIG. 5 is a side view of the storage device of FIG. 1 in its closed condition.

When cover 20 and base 30 are disposed in cooperating relationship so that device 10 is in its closed condition (FIG. 5) device 10 essentially has the form of a rectangular parallelepiped. Referring to FIGS. 1 and 2 device 10 is shown with a hanger hole 100 punched through lip 72 of base 20 and a hanger hole 100 punched through lip 68 of cover 30. Holes 100 are positioned to align with each other in the closed condition of device 10 to allow shoe display and storage device 10 to be hung on a display hook.

Device 10 is assembled by inserting hinge rib 60 into hinge members 52 (FIG. 1) and with cover 30 disposed as shown in FIG. 1 in its open condition and ready to receive a pair of shoes. A first shoe is disposed in device 10 by placing the heel of the shoe into heel portion 40 and the sole of the shoe into sole portion 38 of shape 32. A second shoe is disposed into device 10 by placing its heel in portion 40 and sole in portion 38 of shape 34. Cover 30 is then rotated about hinge members 52 and into its closed condition. Device 10 when so storing a pair of shoes may be hung on a display rod by inserting the rod through aligned holes 100 of the closed device 10. If it is desired to stack a number of devices 10 the upper portion of each cover 30 is of a size and configuration such that it will nest into recess 76 of base 20 of another device 10 thus forming an interlock-stacking of device 10.

Devices 10 may also be utilized to stack or hang shoes at home as well as for purposes of selling.

From the above description it will thus be seen that there has been described a new and improved display and storage device particularly adapted for the display and storage of shoes.

It should be understood that although I have shown the preferred embodiment of my invention that various modifications may be made in the details thereof without departing from the spirit as comprehended by the following claims.

We claim:

1. A shoe storage device for storing at least one shoe of predetermined size and shape, comprising:

(a) base means having a lower recess at an underside thereof;

(b) cover means hingedly secured to said base means, said cover means having dimensions for fitting within the lower recess in the base means of another shoe storage device to provide stacking of a plurality of shoe storage devices;

(c) cavity means formed between said cover means and said base means when said cover means is in a closed position, for receiving at least one shoe therein for storage;

(d) shape means disposed on said beam means and within said cavity means for positioning at least one shoe with a predetermined orientation in said cavity means, said shape means including at least one depression means, each depression means having a size and shape corresponding to said predetermined size and shape of a shoe for receiving the same therein; and (e) releasable lock means on said base means and said cover means for releasably locking said base means to said cover means so that at least one shoe can repeatedly be stored and retrieved from said device.

2. The device of claim 1, wherein said base means, said cover means and said shape means are formed of plastic material.

3. The device of claim 2, wherein said plastic material is transparent.

4. The device of claim 3, wherein said plastic material is tinted to a predetermined color.

5. The device of claim 1, wherein said shape means and said base means are integrally formed as a unit.

6. The device according to claim 1, wherein said shape means includes two depressions for positioning two shoes in said cavity in a side-by-side relation so that the two shoes face outwardly in the same direction.

7. The device of claim 6, wherein said shape means is of a size and configuration to receive the pair of shoes with the heels and soles of the shoes touching said base means, and with the heel of one shoe positioned adjacent the sole of the other shoe.

8. The device of claim 7, wherein said shape means is of a size and configuration to receive the pair of shoes so that when disposed within said cavity there is substantially formed a regular parallelepiped.

9. The device of claim 1, wherein said cover means and said base means are hingedly attached thereto.

10. The device of claim 9, wherein said base means includes at least one hinge member and said cover means includes a hinge rib disposed for coaction with said hinge member.

11. The device of claim 10, wherein said base means includes a pair of hinge members disposed for coaction with said hinge rib.

12. The device of claim 1, wherein said cover means and said base means each include a hole aligned one with the other to facilitate hanging of the storage device on a rod adapted to extend through the aligned holes.

* * * * *